US008674785B2

(12) United States Patent
Hernandez et al.

(10) Patent No.: US 8,674,785 B2
(45) Date of Patent: Mar. 18, 2014

(54) HYDROCARBON RESOURCE PROCESSING DEVICE INCLUDING A HYBRID COUPLER AND RELATED METHODS

(75) Inventors: Victor Hernandez, Merritt Island, FL (US); Lisa Patton, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 262 days.

(21) Appl. No.: 13/294,363

(22) Filed: Nov. 11, 2011

(65) Prior Publication Data

US 2013/0120077 A1 May 16, 2013

(51) Int. Cl.
*H01P 5/12* (2006.01)
*H01P 5/18* (2006.01)

(52) U.S. Cl.
USPC ..... 333/117; 333/122

(58) Field of Classification Search
USPC ..... 333/109, 110, 111, 112, 113, 114, 115, 333/116, 117, 122
See application file for complete search history.

(56) References Cited

U.S. PATENT DOCUMENTS

| | | | | |
|---|---|---|---|---|
| 3,710,063 | A | 1/1973 | Aine | |
| 4,508,168 | A | 4/1985 | Heeren | |
| 4,524,826 | A | 6/1985 | Savage | |
| 4,714,810 | A | 12/1987 | Sirkis | |
| 4,817,711 | A | 4/1989 | Jeambey | |
| 6,936,196 | B2 * | 8/2005 | Chandross et al. | 264/1.36 |
| 7,358,833 | B2 * | 4/2008 | Krupenkin et al. | 333/202 |
| 7,598,898 | B1 | 10/2009 | Funk et al. | |
| 2005/0103307 | A1 | 5/2005 | Yoshimoto | |
| 2006/0112639 | A1 | 6/2006 | Nick | |
| 2008/0265654 | A1 | 10/2008 | Kearl et al. | |
| 2008/0296294 | A1 | 12/2008 | Uhm | |
| 2010/0219108 | A1 | 9/2010 | Parsche | |
| 2011/0277474 | A1 | 11/2011 | Constantz et al. | |
| 2012/0321526 | A1 | 12/2012 | Hernandez et al. | |
| 2013/0041199 | A1 | 2/2013 | Hernandez et al. | |

FOREIGN PATENT DOCUMENTS

| | | |
|---|---|---|
| DE | 102009046881 | 5/2011 |
| WO | 2004057175 | 7/2004 |
| WO | 2006083829 | 8/2006 |
| WO | 2008115226 | 9/2008 |
| WO | 2012173918 | 12/2012 |

OTHER PUBLICATIONS

John F. Gerlin, "Waveguide components and configurations for optimal performance in microwave heating systems", source: http://www.rfdh.com/ez/system/db/lib_app/upload/1774/%5BGerling%5D_WAVEGUIDE_COMPONENTS_AND_CONFIGURATIONS_FOR_OPTIMAL_PERFORMANCE_IN_MICROWAVE, 2000, pp. 1-8.

El harfi et al., "Pyrolysis of the Moroccan (Tarfaya) Oil Shales Under Microwave Irradiation", 2000, vol. 79, pp. 733-742.

Bao et al., Study on Main Factors Influencing Actylene Formation During Coal Pyrolysis in Arc Plasma, 2006, vol. 84, pp. 222-226.

(Continued)

*Primary Examiner* — Dean O Takaoka
(74) *Attorney, Agent, or Firm* — Allen, Dyer, Doppelt, Milbrath & Gilchrist, P.A.

(57) ABSTRACT

A device for processing a hydrocarbon resource may include a radio frequency (RF) source, a first RF conductor, a second RF conductor, and a hybrid coupler assembly coupled to the RF source and the first and second RF conductors. The first and second RF conductors may each having distal ends configured to receive the hydrocarbon resource therebetween and apply RF power from the RF source to the hydrocarbon resource.

19 Claims, 17 Drawing Sheets

(56) References Cited

OTHER PUBLICATIONS

Thomsen et al., Pressurized Laser Pyrolysis of Coal, 1995, vol. 34, pp. 243-250.
Gasner et al., "Microwave and Conventional Pyrolysis of a Bituminous Coal", 1986, pp. 1-7.
Bodily et al., "Microwave Pyrolysis of Coal and Related Hydrocarbons", 1976, pp. 221-226.
Veshcherevich, "Resonant Ring for High Power Tests of RF Couuplers", Cornell University: ERL Reports—2003, ERL 03-15, pp. 1-20.
Tomiyasu, "Attenuation in a Resonant Ring Circuit", IRE Transactions on Microwave Theory and Techniques, vol. 8, Issue 2, 1960, pp. 253-254.

* cited by examiner

HYDROCARBON RESOURCE PROCESSING DEVICE INCLUDING A HYBRID COUPLER AND RELATED METHODS

FIELD OF THE INVENTION

The present invention relates to the field of hydrocarbon resource processing, and, more particularly, to hydrocarbon resource processing devices using radio frequency application and related methods.

BACKGROUND OF THE INVENTION

As the world's standard crude oil reserves are depleted, and the continued demand for oil causes oil prices to rise, attempts have been made to process all manner of hydrocarbons in increasingly varied ways. For example, attempts have been made to heat subsurface heavy oil bearing formations using steam, microwave energy, and RF energy. However, these attempts have been generally inefficient and costly.

Sublimation or pyrolysis of substances such as coal and shale oil may yield valuable products, such as natural gas. Sublimation is essentially taking a material from its solid phase to its gaseous phase without the presence of a liquid phase. Pyrolysis, on the other hand, involves the chemical decomposition of organic substances by heating to break down hydrogen bonds. Such a process may produce natural gas from the sublimated or pyrolyzed substances with low greenhouse gas emissions. However, existing technologies require more energy to sublimate or pyrolyze substances such as coal or shale oil than the energy that is produced.

Pyrolysis differs from other processes (combustion and hydrolysis) in which the reactions do not involve oxygen or water. Pyrolysis of organic substances typically produces gas and liquid products and leave behind a carbon rich solid residue. In many industrial applications, the process is done under pressure and at operating temperatures above 430° C. Since pyrolysis is endothermic, problems with current technologies exist in which biomass substances are not receiving enough heat to efficiently pyrolyze and result in poor quality. For such cases, it becomes imperative for an initiation reaction to be used to enhance the amount of heat applied to the hydrocarbon material.

As the organic chemical structures of various hydrocarbons ages, the aromaticity (defined as the ratio of aromatic carbon to total carbon) increases. These aromatic structures are chains of carbons that are targeted for breaking during heating processes. In order for the production of natural gas to occur, these large complex structures break during reactions and thus, increase the solubility of the organic portion of the substance. Some of these reactions are (but not limited to) cracking, alkylation, hydrogenation, and depolymerization.

Thus, various hydrocarbon materials must be extensively processed in order to achieve maximum fuel production. In industry, upgrading facilities are used in order to further make the material usable and more valuable. It is possible that the RF energy applied in this technology could be used to also change the molecular structure of the material by breaking it into smaller components bypassing the need for the hydrocarbons to be processed and treated at upgrading facilities.

SUMMARY OF THE INVENTION

In view of the foregoing background, it is therefore an object of the present invention to increase the efficiency of hydrocarbon resource sublimation and/or pyrolysis.

This and other objects, features, and advantages in accordance with the present invention are provided by a device for processing a hydrocarbon resource. The device includes a radio frequency (RF) source, a first RF conductor, and a second RF conductor. The device also includes a hybrid coupler assembly coupled to the RF source and the first and second RF conductors. The first and second RF conductors each have distal ends configured to receive the hydrocarbon resource therebetween and apply RF power from the RF source to the hydrocarbon resource. Accordingly, the hydrocarbon resource processing device may provide increased efficiency in hydrocarbon resource sublimation and/or pyrolysis.

The hybrid coupler assembly may include a first hybrid coupler having a plurality of ports, one of the plurality of ports coupled to the RF source and another of the plurality of ports coupled to the first RF conductor. The hybrid coupler assembly may also include a second hybrid coupler having a plurality of ports. One of the plurality of ports is coupled to a further one of the plurality of ports of the first hybrid coupler.

The hybrid coupler assembly may further include a third hybrid coupler having a plurality of ports. One of the plurality of ports is coupled to the second RF conductor, for example. The second hybrid coupler may be coupled in series between the first and third hybrid couplers via the further one of the plurality of ports of the first hybrid coupler and another of the plurality of ports of the third hybrid coupler.

The device may further include a hydrocarbon processing container coupled between the distal ends of the first and second RF conductors. The hydrocarbon processing container has a pair of RF treatment ports aligned with corresponding ends thereof, for example.

A method aspect is directed to a method of processing a hydrocarbon resource. The method includes applying radio frequency (RF) power from an RF source to distal ends of a first RF conductor and a second RF conductor having the hydrocarbon resource therebetween. The RF power is applied via a hybrid coupler assembly coupled to the RF source and the first and second RF conductors.

DETAILED DESCRIPTION OF THE PREFERRED EMBODIMENTS

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Figure 1:
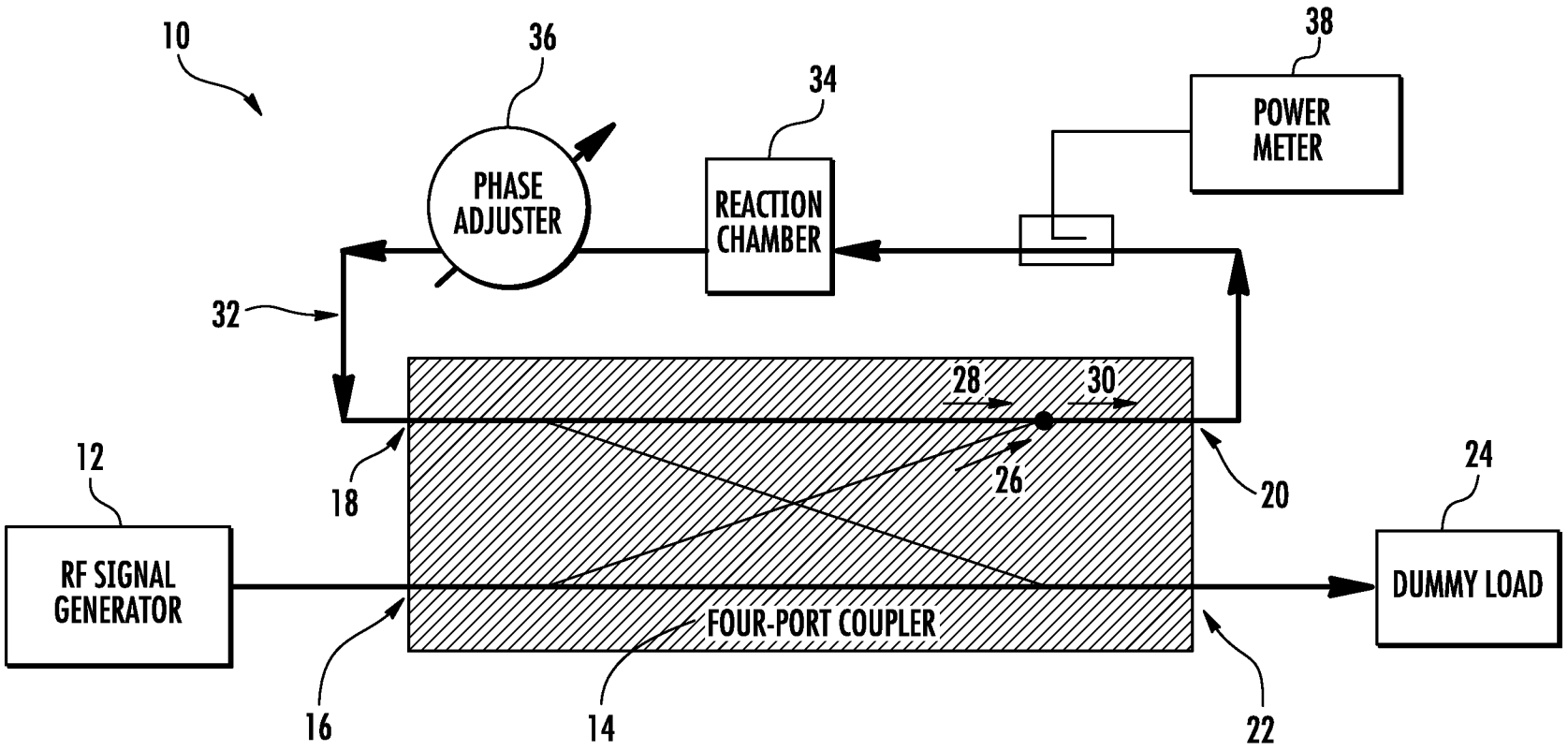
FIG. 1 illustrates an embodiment of the present process for sublimation/pyrolysis using RF energy.

FIG. 1 illustrates an embodiment of the present apparatus 10 for sublimation/pyrolysis of coal, shale oil and other hydrocarbons using RF energy. An RF signal generator 12 supplies power to a resonant ring 32 through a four-port coupler 14. For the purpose of this invention, a transmitter of a non-specific power range is used to supply power to the resonant ring. RF signal generator 12 is connected to four-port coupler 14 at first port 16. Electrical power 26 generated by RF signal generator 12 enters resonant ring 32 at third port 20 and travels through reaction chamber 34 and phase adjuster 36, and returns to four port coupler 14 at second port 18. All or a portion of this power joins incoming power 26 from RF signal generator 12 to form power 30, which then repeats the circuit around resonant ring 32. A power meter 38 may be connected to resonant ring 32 between third port 20 and reaction chamber 34.

The resonant cavity is used to contain hydrocarbon material and provide a flexible pyrolysis/sublimation reaction chamber for evaluating optimal RF frequency versus RF power versus secondary bias source (wavelength and intensity) for a given heat range. RF discharge plasma generated in the resonant cavity 52 of the reaction chamber 34 (see FIG. 2) creates a measurable gas production. The resonant ring 32 will support continuous fuel production and can be tuned as discussed below.

The structure of resonant ring 32 and phase adjuster 36 serve to "tune" resonant ring 32 to a resonant frequency of reaction chamber 34 to optimize sublimation/pyrolysis in reaction chamber 34. Phase adjuster 36 can adjust the phase of the wave front 30 traveling resonant ring 32 to achieve an integral multiple of the resonant wavelength. The RF energy in reaction chamber 34 is used to break the covalent bonds of hydrocarbon molecules placed in reaction chamber 34 without heat. As a result, temperatures in reaction chamber may be optimal for sublimation and/or pyrolysis. Sublimation will convert the material, whereas the pyrolysis will decompose it by breaking its covalent bonds. During the pyrolysis decomposition process, the heavy material will break down into lighter more desirable compounds. This will be achieved by synchronizing the RF signal field of generator 12 with the resonant ring 32 propagation characteristics. Tuning the process within its operating temperature range, approximately 45° C.-500° C., may be useful to favor the decomposition process discussed (break the covalent bonds). In addition, this process promotes the generation of hydrogen and minimizes the production of sulfur. This is a form of upgrading which the sublimation and/or pyrolysis process brings about and results in the production of natural gas. The tuning of the power to reach the desired temperature for this process to occur provides an optimally lower temperature and minimizes energy consumption, which improves system efficiency.

A dummy load 24 is a passive device connected to four-port coupler 14 at fourth port 22. Dummy load 24 is used to absorb and dissipate energy not needed for the sublimation/pyrolysis process. Thus, not all power entering four port coupler 14 at second port 18 joins the power 26 from signal generator 12 as some may be diverted to dummy load 24. The four port coupler is sized appropriately to minimize the dissipated power to insure system efficiency.

Figure 2:
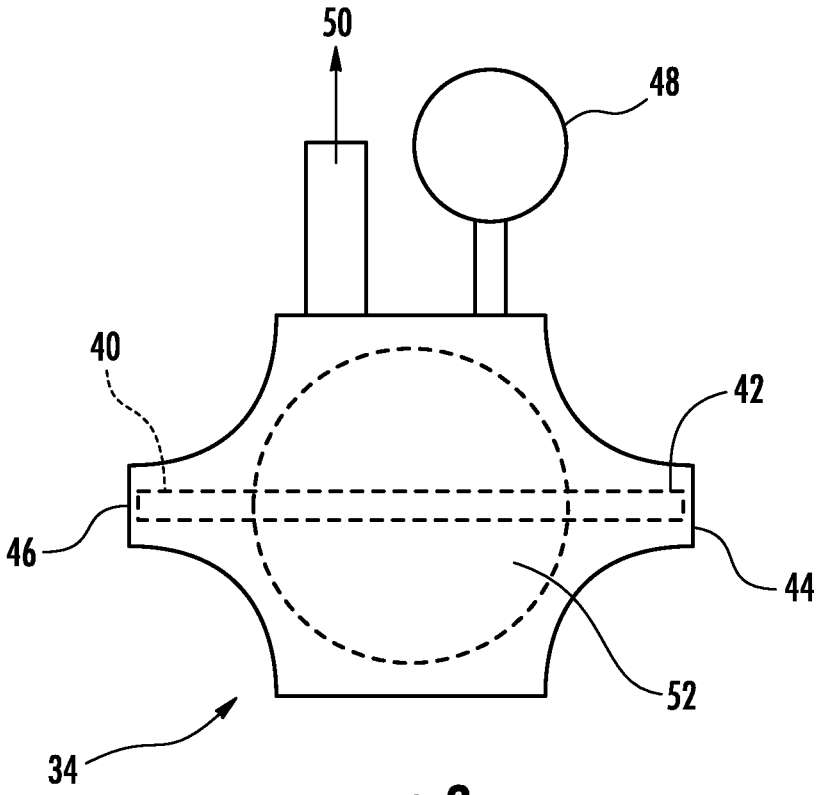
FIG. 2 illustrates a reaction chamber associated with the present process for sublimation/pyrolysis using RF energy of FIG. 1.

FIG. 2 provides a closer look at reaction chamber 34, which is shown separate from resonant ring 32. RF energy enters reaction chamber 34 at first connection 44 and exits at second connection 46. Reaction chamber 34 is coupled to resonant ring 32 through dielectric pressure ports 40 and 42. Dielectric pressure ports 40 and 42 are windows that are transparent to RF energy, but mechanically isolate resonant cavity 52 of reaction chamber 34 from the resonant ring 32 with regard to the material sublimation/pyrolysis process taking placed in reaction chamber 34. The construction of the reaction chamber is not materials specific and may consist of one or combination of suitable materials.

RF energy is used to break the covalent bonds of hydrocarbons introduced into resonant cavity 52 of reaction chamber 34 and release gaseous products, which then exit reaction chamber 34 at gas port 50. A gas chromatograph (not shown) may be connected in the gas stream at or near gas port 50 to monitor the byproducts of the content of the gas stream leaving reaction chamber 34 to facilitate tuning of the process. This gas stream 34 may contain lighter components, such as, but not limited to methane, propane, and various derivatives of alcohols. Such off-gasing components will exist during the process (both sublimation and pyrolysis) temperatures are in the range of 45° C.-500° C. Pressure and temperature measurement devices 48 are in functional contact with resonant cavity 52.

Equating component waves around resonant ring 32 may be predicted according to the following formulas:

$$E_4 = E_4 e^{-i\phi}\left(10^{\frac{-\partial}{20}}\right)\sqrt{1-c^2} + cE_1$$

$$cE_1 = E_4\left(1 - e^{-i\phi}\left(10^{\frac{-\partial}{20}}\right)\sqrt{1-c^2}\right)$$

$$\frac{E_4}{E_1} = \frac{c}{1 - e^{-i\phi}\left(10^{\frac{-\partial}{20}}\right)\sqrt{1-c^2}}$$

$$\frac{P_4}{P_1} = \left\{\frac{c}{1 - e^{-i\phi}\left(10^{\frac{-\partial}{20}}\right)\sqrt{1-c^2}}\right\}^2$$

$$G_{linear} = \left\{\frac{c}{1 - \left(10^{\frac{-\partial}{20}}\right)\sqrt{1-c^2}}\right\}^2$$

$$G_{linear} = \left\{\frac{10^{\frac{-C}{20}}}{1 - \left(10^{\frac{-\partial}{20}}\right)\sqrt{1 - \left(10^{\frac{-C}{20}}\right)^2}}\right\}^2$$

Where:

$G_{linear}$=the linear power gain;

α=the attenuation around the loop in dB;

$\Phi=2n\pi\lambda$, where n is an integer;

C=coupling factor in dB; and $c=10^{-C/20}$

The ring performance can be measured using the power gain equation which is dependent on several variables within the system: coupling coefficient, attenuation and reflection in the ring, transmission, and electrical length.

Figure 3:
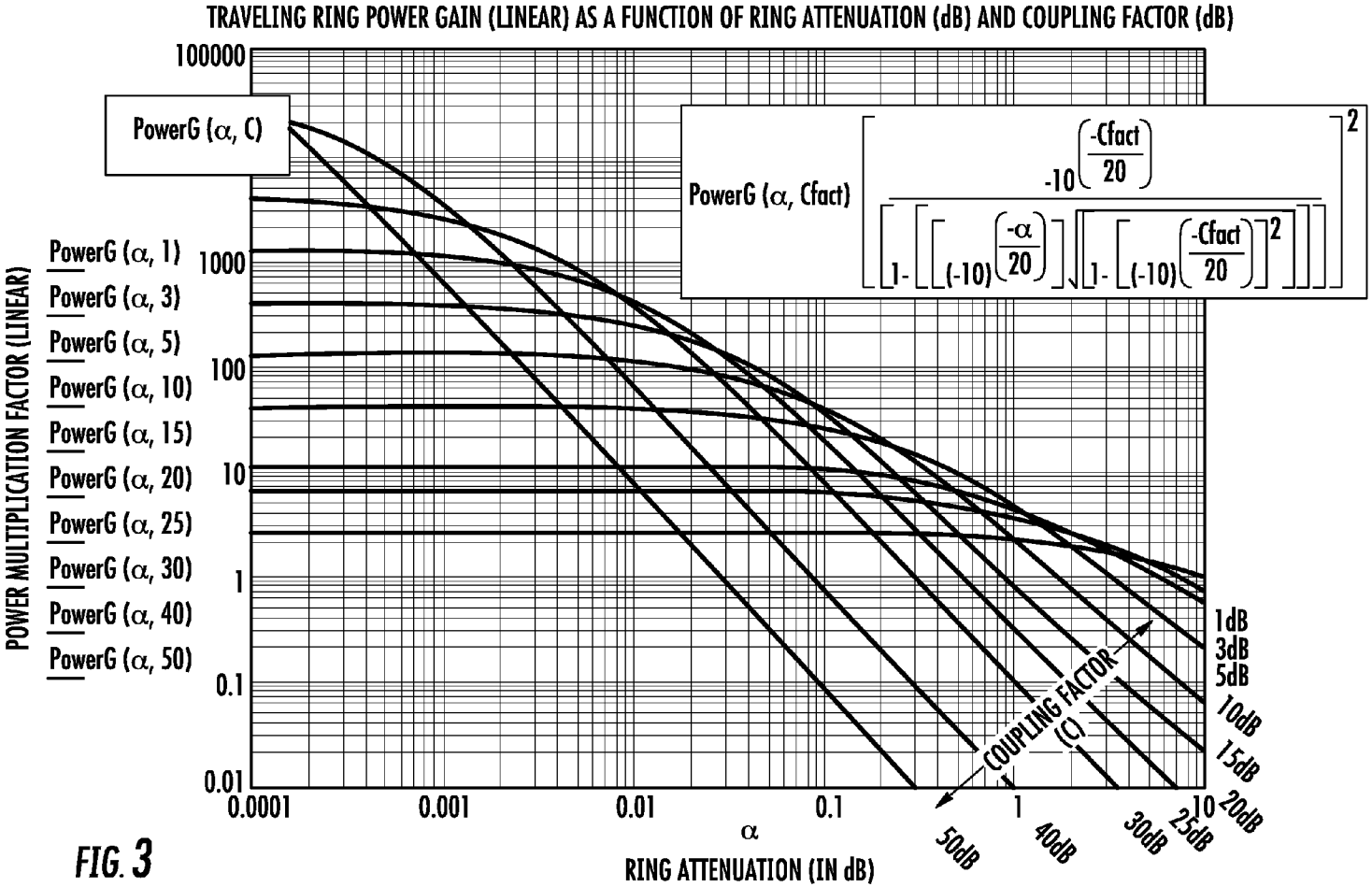
FIG. 3 illustrates the ring power gain as a function of ring attenuation for the embodiment illustrated in FIG. 1.
Figure 4:
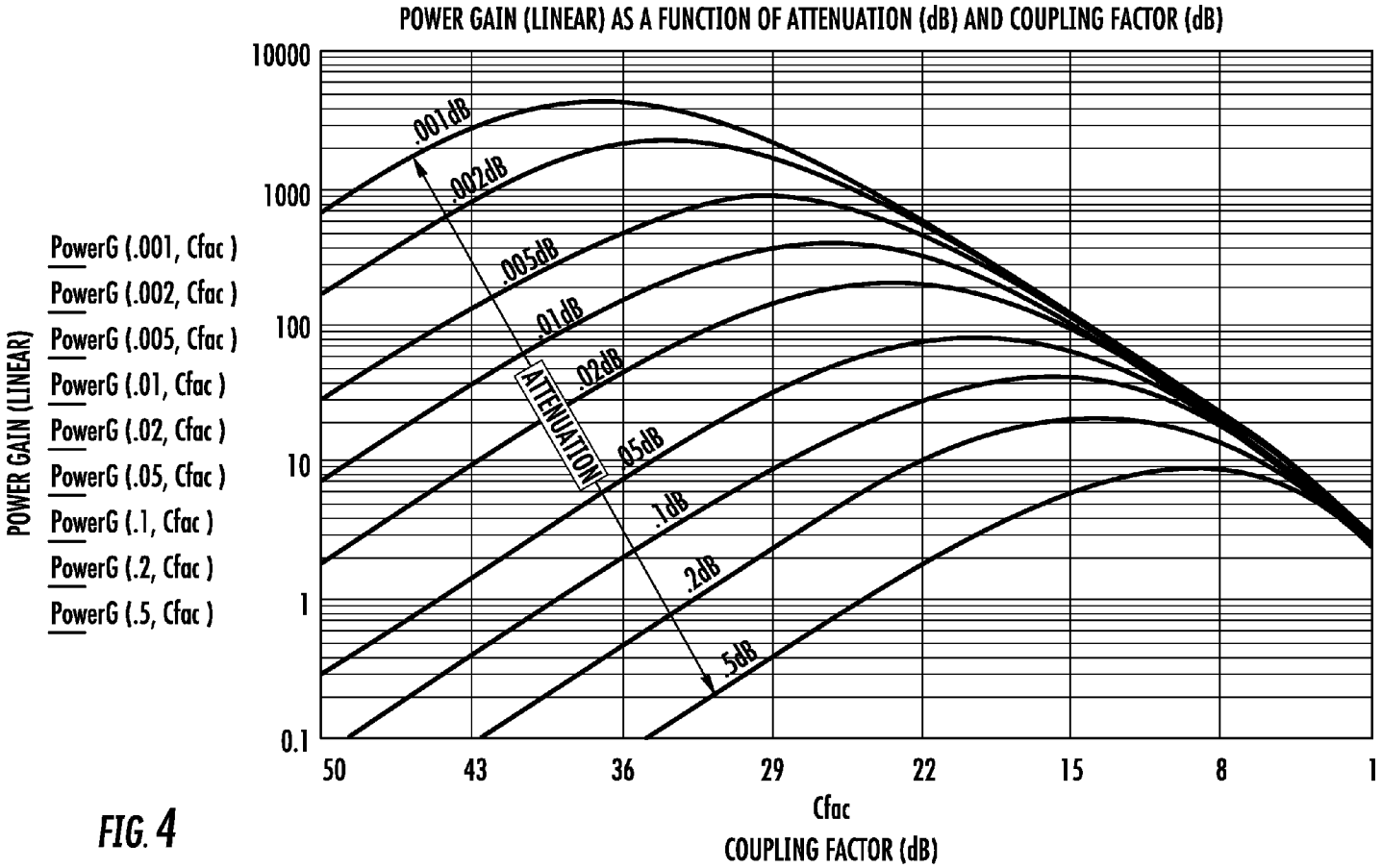
FIG. 4 illustrates the ring power gain as a function of coupling factor for the embodiment illustrated in FIG. 1.
Figure 5:
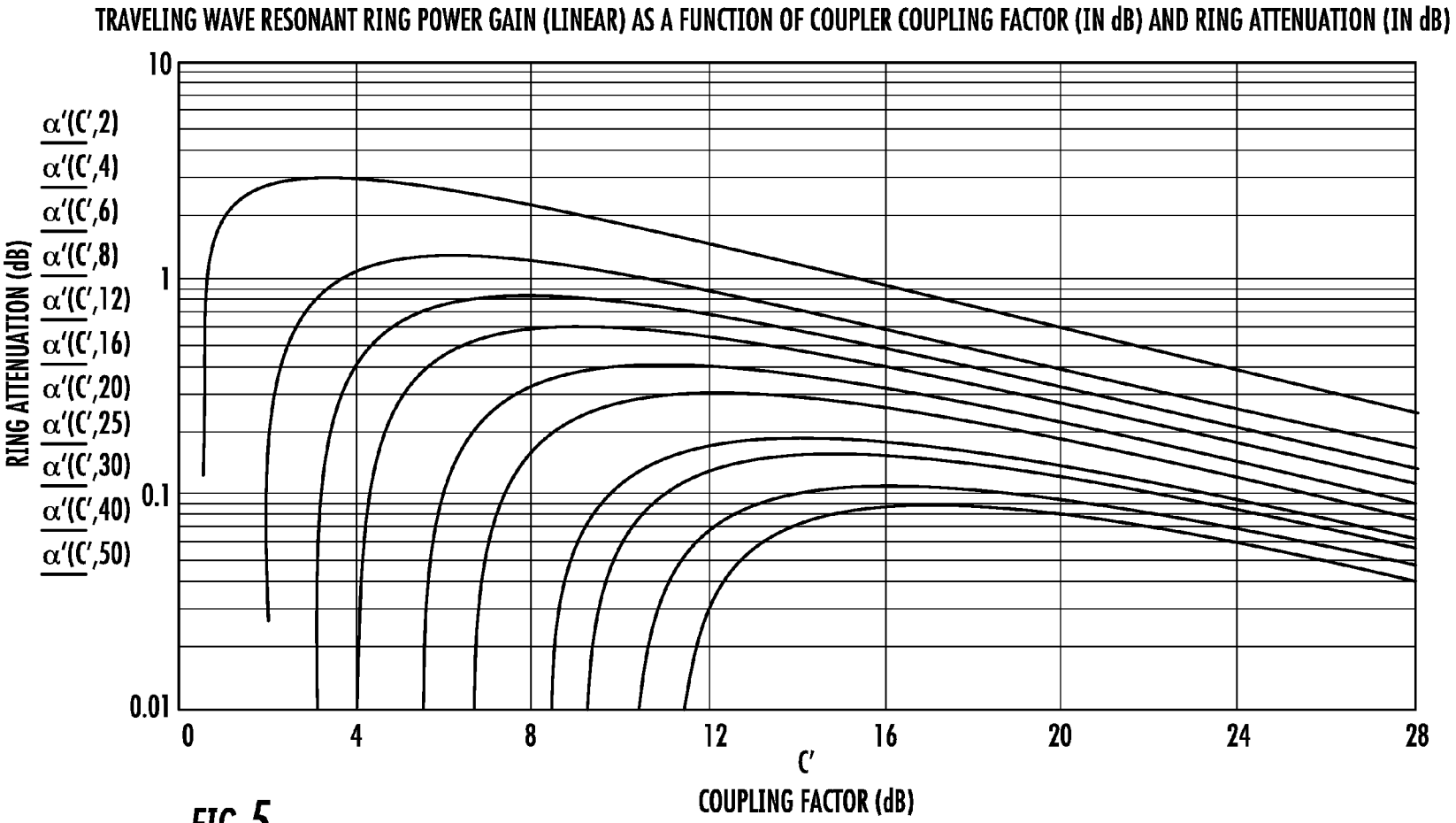
FIG. 5 illustrates the ring attenuation as a function of coupling factor for the embodiment illustrated in FIG. 1.

FIGS. 3-5 illustrate performance characteristics of resonant ring 32 in three different ways. Turning to FIG. 3, the power gain (G) of resonant ring 32 is shown as a function of ring attenuation ($\alpha$). Coupling factor (C) is represented across the graph, as four port coupler 14 is variable in character. The present apparatus for sublimation/pyrolysis using RF energy 10 is designed to have a very small power loss around resonant ring 32.

FIG. 4 looks at the performance of resonant ring 32 using the power gain (G) around resonant ring 32 as a function of coupling factor (C). Here, ring attenuation (a) is represented across the graph. There exists the optimal coupling coefficient and the power gain is maximal.

In FIG. 5, the ring attenuation (a) is shown as a function of coupling factor (C). Power gain (G) is represented across the graph at the high end of the coupling factor (C). This figure is another way to express the traveling wave guide and determine the maximum power gain possible at the specified coupling factor.

Overall, a signal generator is coupled to a resonant ring implementation fixture. The resonant cavity is structured in such a way to receive high power and synchronize the RF signal generator with the resonant ring structure. The pyrolysis and/or sublimation reaction chamber is coupled to the resonant ring through dielectric ports. This reaction chamber is designed to easily evaluate the optimal RF frequency, RF power, and wavelength and intensity in order to maximize the amount of outputs from the hydrocarbon substance that is under processing. RF discharge substances generated during the chemical reactions of the pyrolysis/sublimation are to be measured and analyzed. The resonant ring is designed to support continuous operation.

Figure 6:
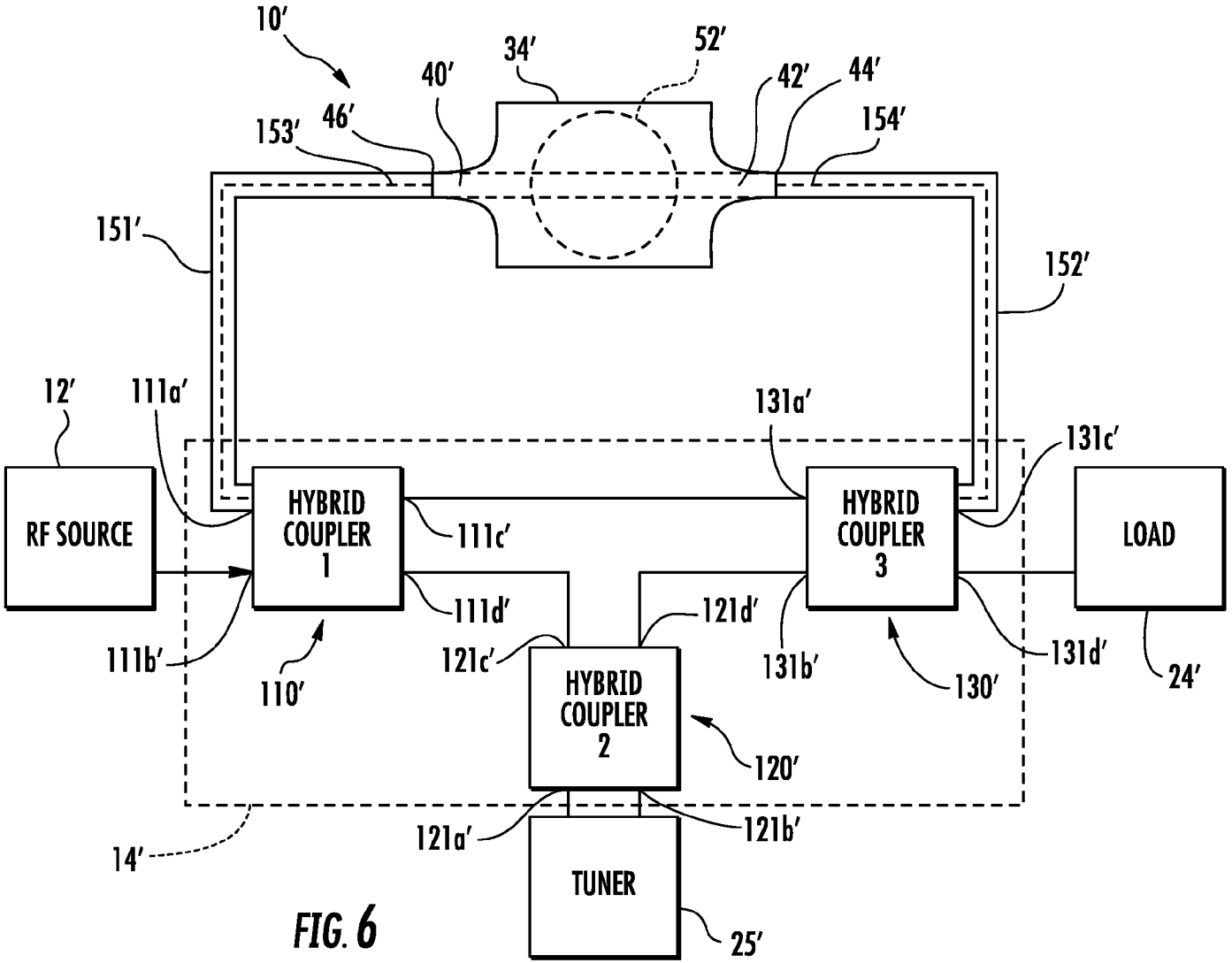
FIG. 6 is a schematic diagram of a hydrocarbon processing device according to another embodiment.

Referring now additionally to FIG. 6, another embodiment is directed to an apparatus 10' for processing a hydrocarbon resource. The apparatus 10' illustratively includes a coupler assembly 14'. The coupler assembly 14' includes a first hybrid coupler 110' that includes a plurality of ports 111*a*'-111*d*'.

Figure 7:
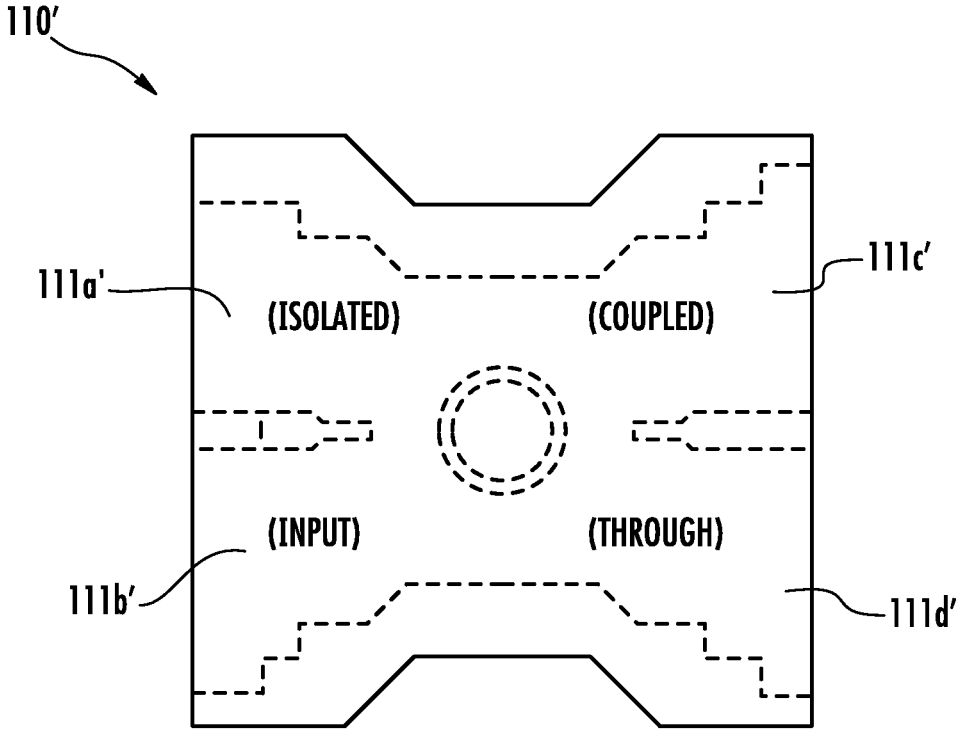
FIG. 7 is a schematic diagram of a hybrid coupler of the device in FIG. 6.

Referring now additionally to FIG. 7, an exemplary first hybrid coupler 110' is illustrated. As will be appreciated by those skilled in the art, as a hybrid coupler, for example, a 90° hybrid coupler, the ports 111*a*'-111*d*' of the first hybrid coupler 110' include a input port, an isolated port, a coupled port, and a through port. For ease of explanation, the coupling characteristics of the ports 111*a*'-111*d*' will be described with reference to the input port. The coupling characteristic from the input port to the through port is a −3 dB loss with no phase shift. The coupling characteristic from the input port 111*b*' to the isolated port 111*a*' is zero loss and zero phase shift. In other words, the isolated port 111*e* is electrically isolated from the input ports. The coupling characteristic from the input port to the coupled port 111*c*' is a −3 dB loss and a $-\pi/2$ radians phase shift. As will be appreciated, these coupling characteristics assume that all the ports are matched. Moreover, the coupling characteristics of any port can be found symmetrically with reference to the input port. In other words, any one port may have any coupling characteristics at any point in time so long as the coupling characteristic relationships described above are maintained An RF source 12' is coupled to a port 111*b*' of the first hybrid coupler 110'. The RF source 12' may be in the form of a variable frequency transmitter, for example. The RF source 12' may be tuned to a frequency based upon the hydrocarbon resource being processed, as will be appreciated by those skilled in the art.

A first RF conductor 151' is also coupled to a port 111*a*' of the first hybrid coupler 110'. The first RF conductor 151' may be in the form of a coaxial cable. Alternatively, the first RF conductor 151' may be in the form of a waveguide. The first RF conductor 151' may be another type of RF conductor.

The coupler assembly 14' also includes a second and a third hybrid coupler 120', 130'. The second and third hybrid couplers 120', 130' are configured similarly to the first hybrid coupler 110', with respect to the coupling characteristics. A port 111*c*' of the first hybrid coupler 110' is coupled to a port 131*a*' of the third hybrid coupler 130'. The second hybrid coupler 120' is illustratively coupled in series between the first and third hybrid couplers 110', 130'. In other words, a port 121*c*' of the second hybrid coupler 120' is coupled to a port 111*d*' of the first hybrid coupler 110', and another port 121*d*' of the second hybrid coupler 120' is coupled to a port 131*b*' of the third hybrid coupler 130'.

A stub tuner 25' in the form of a stub tuner, for example, is coupled to two ports of the second hybrid coupler 120'. The tuner 25' may be a manually controlled stub tuner or an RF short, for example. The tuner 25' may be another type of tuner, as will be appreciated by those skilled in the art. The tuner 25' advantageously cooperates with the second hybrid coupler 120' so that the second hybrid coupler may be regarded as a variable hybrid coupler.

Figure 8A:
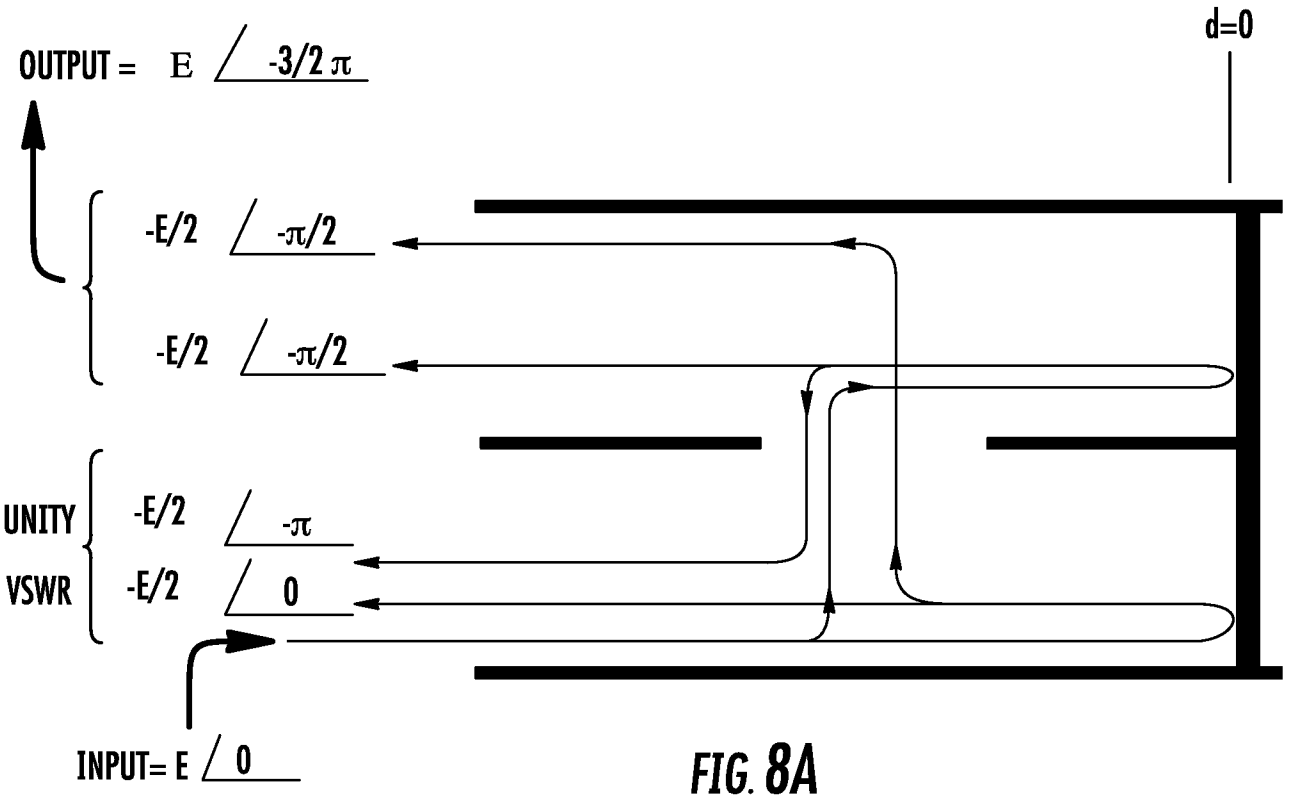
FIG. 8*a* is a coupling characteristic diagram of a hybrid coupler coupled to the tuner of FIG. 6.
Figure 8B:
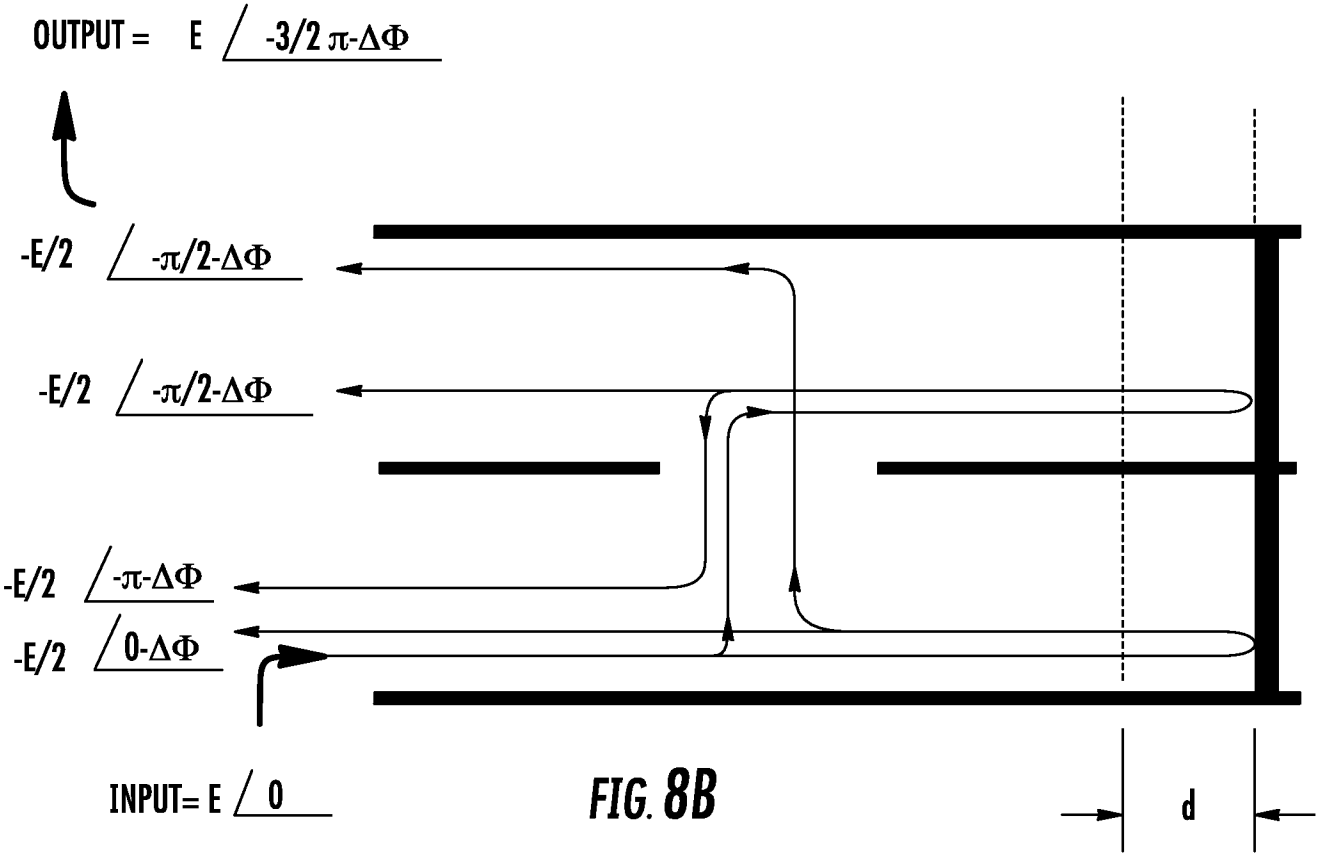
FIG. 8*b* is another coupling characteristic diagram of a hybrid coupler coupled to the tuner of FIG. 6.

Referring additionally to FIGS. 8*a*-8*b*, coupling characteristics of the second hybrid coupler 120' with the tuner 25' coupled to two ports are illustrated. FIG. 8*a* illustrates an RF short created by the tuner 25', the short is denoted by d=0, where d is a distance. The coupling characteristics described above are illustrated with reference to the magnitude of the electric field and phase shift, wherein E is the magnitude of the electric field. As will be appreciated by those skilled in the art, the second hybrid coupler 120' may be near lossless with a voltage standing wave ratio (VSWR) near unity.

Referring now to FIG. 8*b*, as the tuner 25' is adjusted, the distance d is increased. A further phase shift is introduced based upon the distance, which is denoted by $\Delta\Phi$. More particularly, $\Delta\Phi=(4\pi/\lambda)d$, where $\lambda$ is the wavelength of the desired operating frequency. Further operation of the device with respect to the hybrid couplers 110', 120', 130' will be described in detail below.

A second RF conductor 152' is coupled to a port 131*c*' of the third hybrid coupler 130'. Similar to the first RF conductor 151', the second RF conductor 152' may be in the form of a coaxial cable, a waveguide, or other type of RF conductor, as will be appreciated by those skilled in the art.

The first and second RF conductors 151', 152' each have distal ends 153', 154', respectively that are configured to receive the hydrocarbon resource therebetween. In particular, a hydrocarbon processing container 34' may be coupled between the distal ends 153', 154' of the first and second RF conductors 151', 152'. The hydrocarbon resource is advantageously processed or treated, for example, pyrolyzed, upgraded, etc., within a cavity of hydrocarbon processing container 34'. The hydrocarbon processing container 34' includes a pair of RF treatment ports 40', 42' therein aligned with a corresponding ends 46', 44' that receive the first and second RF conductors 151', 152' therein. The RF treatment ports 40', 42' may be dielectric pressure ports, for example. The hydrocarbon processing container 34' may include additional ports therein, for example, for gas escape, and pressure and temperature measurements, for example.

The first and second RF conductors 151', 152' coupled to hydrocarbon processing container 34' define a ring or loop. The first and second RF conductors 151', 152' are configured so that they have a summed length of 2nnλ where n is an integer and λ is the wavelength of the desired RF frequency from the RF source 12'. In other words, the first and second RF conductors 151', 152' have a length that corresponds to the resonant frequency of the signal from the RF source 12'. Power from the RF source 12' is applied so that the hydrocarbon resource between the distal ends is treated or processed, which advantageously results in pyrolization, upgrading, cracking, etc.

In some embodiments, for example, for processing hydrocarbon resources in-situ, i.e., in a subterranean formation, a hydrocarbon processing container 34' may not be used. In these embodiments, the hydrocarbon resource is passed between the distal ends 153', 154' of the first and second RF conductors 151', 152' while power is applied.

A load 24', for example, a dummy load, is coupled to a port 131*d*' of the third hybrid coupler 130'. Any excess power that may not be applied by the first and second RF conductors 151', 152' is advantageously directed to the load 24'.

Figure 9:
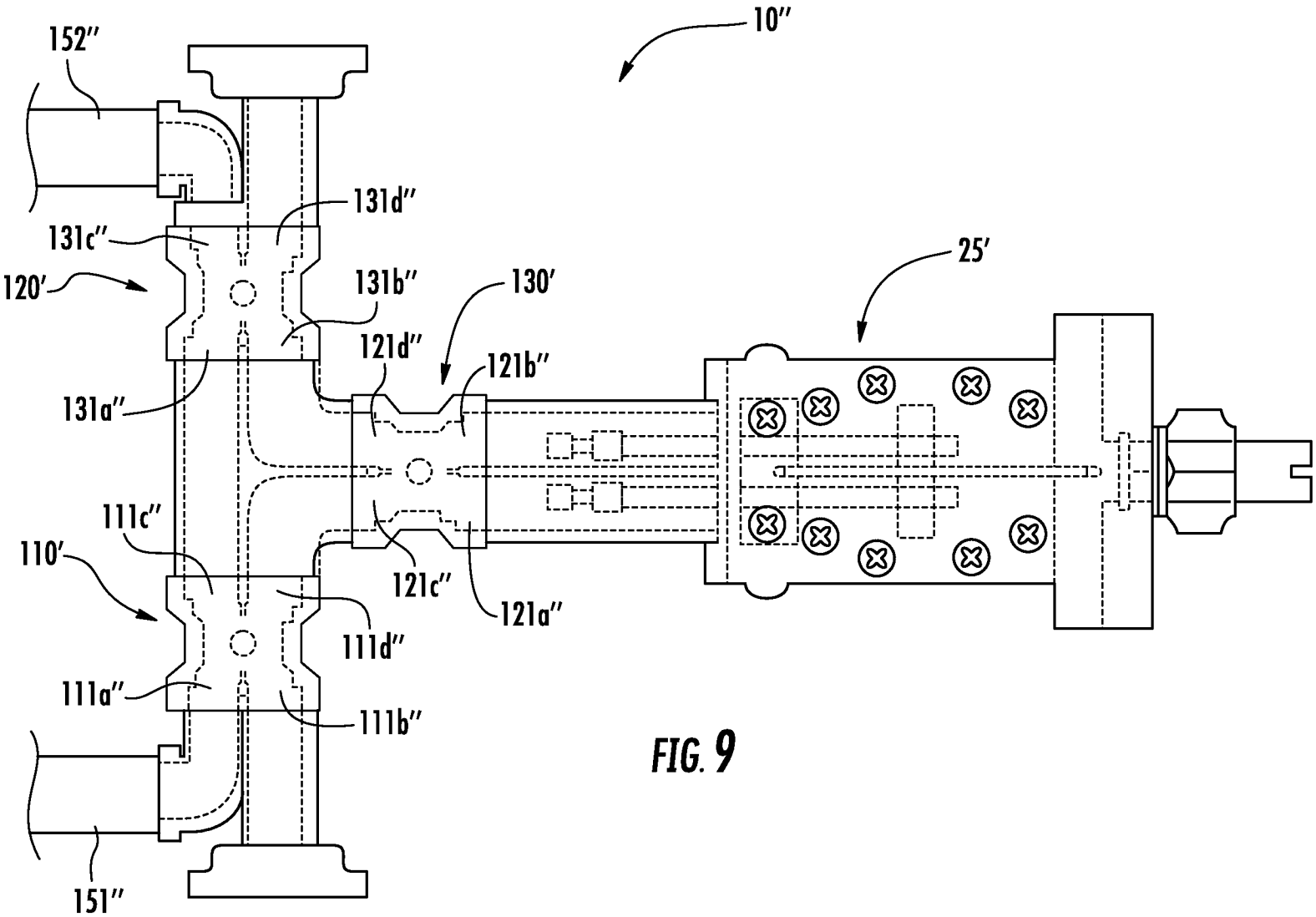
FIG. 9 is a schematic diagram of a hydrocarbon processing device according to another embodiment.

Referring now additionally to FIG. 9, a phasor analysis of a portion of an apparatus 10" according to an embodiment is described. In the illustrated embodiment, the first and second RF conductors 151", 152" are in the form of waveguides.

Illustratively, power from the RF source enters a port 111*b*" of the first hybrid coupler 110". Power entering the first hybrid coupler 110" has no relative phase shift, E^2/0, according to power/phase shift. The magnitude of the electric field leaving first hybrid coupler 110" at port 111*d*" is (E/√2)/0, and the magnitude of the electric field leaving the first hybrid coupler 110" at port 111*c*" is (E/√2)/(−π/2). The magnitude of the electric field leaving the second hybrid coupler 120" at port 121" is (E/√2)/(−(3/2)π−ΔΦ). The magnitude of the electric field leaving the third hybrid coupler 130" at port 131*c*" is ((E/2)/−ΔΦ))+((E/2)/(−π/2)=E/(−n/2) if ΔΦ=π/2 or 0 if ΔΦ=(3/2)π. The magnitude of the electric field at port 131*d*" of the third hybrid coupler 130" is ((E/2)/−(3/2)π−ΔΦ))+((E/2)/−π)=0 if ΔΦ=π/2 or E if ΔΦ=(3/2)π.

Converting from phasor notation to a complex number representation of the signal, in time domain, the electric field may be written as follows:

$$
\begin{aligned}
E(t) &= \mathrm{Real}\left\{\frac{E}{2}\left\{e^{i\left(wt-\frac{3}{2}\pi-\phi\right)}+e^{i(wt-\pi)}\right\}\right.\\
&= \mathrm{Real}\left\{\frac{E}{2}\left\{e^{iwt}\left[e^{i\left(-\phi-\frac{3}{2}\pi\right)}+e^{-i\pi}\right]\right\}\right.\\
&= \mathrm{Real}\left\{\frac{E}{2}\left\{e^{iwt}e^{i\left(-\frac{5}{4}\pi\right)}\left[e^{i\left(-\phi-\frac{1}{4}\pi\right)}+e^{i\left(+\frac{1}{4}\pi\right)}\right]\right\}\right.\\
&= \mathrm{Real}\left\{Ee^{iwt}e^{-\frac{5}{4}\pi i}e^{-\frac{\phi}{2}i}\left[\frac{e^{i\left(-\frac{\phi}{2}-\frac{1}{4}\pi\right)}+e^{i\left(\frac{\phi}{2}+\frac{1}{4}\pi\right)}}{2}\right]\right\}\\
&= \mathrm{Real}\left\{Ee^{i\left(wt+\frac{5}{4}\pi-\frac{\phi}{2}\right)}\left[\frac{e^{i\left(\frac{\phi}{2}+\frac{\pi}{4}\right)}+e^{-i\left(\frac{\phi}{2}+\frac{\pi}{4}\right)}}{2}\right]\right\}\\
&= E\cos\left(\frac{\phi}{2}+\frac{\pi}{4}\right)\cos\left(wt+\frac{5}{4}\pi-\frac{\phi}{2}\right)
\end{aligned}
$$

It should be noted that E(t)=0 when Φ=π/2, and E(t)=E when Φ=3/2π.

To calculate the "response" with respect to frequency, it is assumed that the device 10" is set to a maximum coupling factor, which corresponds to the largest phase delay, that the frequency is set to center of the band, and that the input frequency is varied across its maximum range (Assume +/−1 GHz). It should be noted that $f_0$ denotes the center of the band and Δf represents the instantaneous frequency.

$$
\begin{aligned}
\phi_0 &= 2\beta d_0\\
&= 2\left(\frac{2\pi}{\lambda_0}\right)d_0\\
&= 4\pi d_0 f\\
&= 4\pi d_0 f_0\left(1+\frac{\Delta f}{f_0}\right)
\end{aligned}
$$

$$
E(t) = E\cos\left[2\pi d_0 f_0\left(1+\frac{\Delta f}{f_0}\right)-\frac{\pi}{4}\right]\cos(wt+\theta)
$$

$$
\begin{aligned}
\phi_{max} &= \frac{3}{2}\pi\\
&= \frac{4\pi}{\lambda}d_0 \Rightarrow d_{max}\\
&= \frac{3}{8}\lambda
\end{aligned}
$$

$$
\begin{aligned}
\phi_{min} &= \frac{1}{2}\pi\\
&= \frac{4\pi}{\lambda}d_0 \Rightarrow d_{min}\\
&= \frac{1}{8}\lambda
\end{aligned}
$$

The change in amplitude resulting from the differential phase shift of the instantaneous frequency excursions can be calculated as follows:

Let Δf1=1 GHz (maximum excursion from the center of the band)

And Δf2=0 GHz (center of the band)

Then $$
\begin{aligned}
\text{Flatness} &= \cos\left[2\pi\left(\frac{3}{8}\right)\left(\frac{1}{f_0}\right)f_0\left(1+\frac{\Delta f_1}{f_0}\right)+\frac{\pi}{4}\right]-\\
&\quad \cos\left[2\pi\left(\frac{3}{8}\right)\left(\frac{1}{f_0}\right)f_0\left(1+\frac{\Delta f_2}{f_0}\right)+\frac{\pi}{4}\right]\\
&= \cos\left[\frac{3}{4}\pi+\frac{3}{4}\pi\left(\frac{1}{45}\right)+\frac{\pi}{4}\right]-\cos\left[\frac{3}{4}\pi+\frac{3}{4}\pi\left(\frac{0}{45}\right)+\frac{\pi}{4}\right]\\
&= \cos(1.0167\pi)-\cos(\pi)\\
&= -0.9998-(-1)\\
&= 0.0016
\end{aligned}
$$

This equates to a −56 dB change across the band. The analysis shows that hybrid coupler design can deliver a relatively very flat frequency response, as will be appreciated by those skilled in the art.

Figure 10:
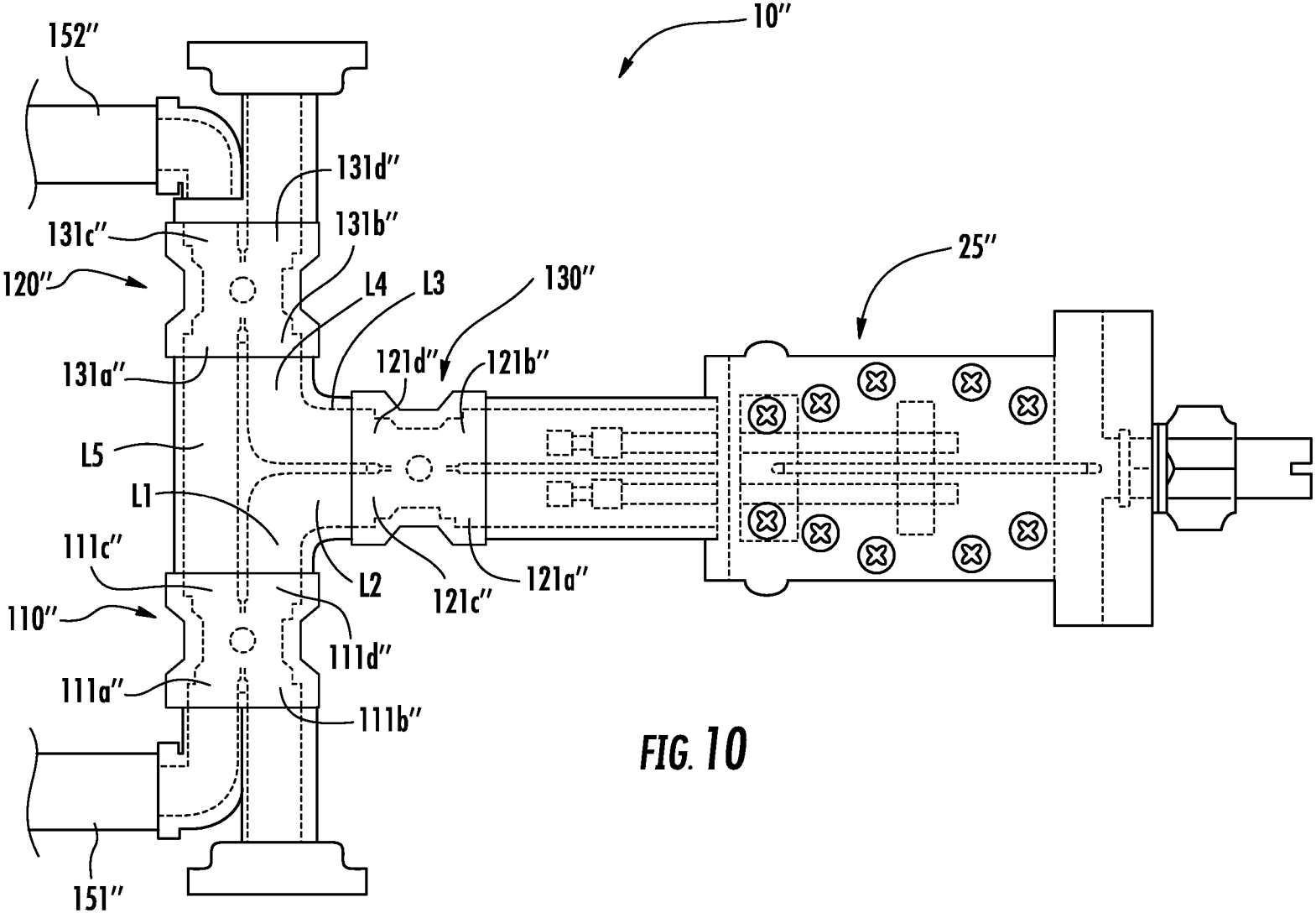
FIG. 10 is another schematic diagram of the hydrocarbon processing device of FIG. 9.

Referring additionally to FIG. 10, further analysis with respect to increased performance of a portion of the apparatus 10" is described. More particularly, the magnitude of the electric field leaving the third hybrid coupler 130" at port 131*c*" is ((E/2)/−ΔΦ−$\Phi_B$))+((E/2)/((−π/2)−$\Phi_A$) where $\Phi_A$=β($L_5$) and $\Phi_B$=β($L_1$+$L_2$+$L_3$+$L_4$). The magnitude of the electric field at port 131*d*" of the third hybrid coupler 130" is ((E/2)/−(3/2)π−ΔΦ−$\Phi_B$))+((E/2)/−π−$\Phi_A$) also where $\Phi_A$=β($L_5$) and $\Phi_B$=β($L_1$+$L_2$+$L_3$+$L_4$). As will be appreciated by those skilled in the art, L is the distance in question in the same units used to define the wavelength. Accordingly:

$$\text{Let_}\phi_A = \beta(L_5)$$
$$\text{and_}\phi_B = \beta(L_1 + L_2 + L_3 + L_4)$$
Then:

$$\begin{aligned}
E(t) &= \text{Real}\left\{\frac{E}{2}\left\{e^{i\left(wt-\frac{3}{2}\pi-\phi-\phi_B\right)} + e^{i(wt-\pi-\phi_A)}\right\}\right\} \\
&= \text{Real}\left\{\frac{E}{2}e^{iwt}\left[e^{i\left(-\phi-\frac{3}{2}\pi-\phi_B\right)} + e^{-i\pi-\phi_A}\right]\right\} \\
&= \text{Real}\left\{\frac{E}{2}e^{iwt}e^{i\left(-\frac{5}{4}\pi\right)}\left[e^{i\left(-\phi-\frac{1}{4}\pi-\phi_B\right)} + e^{i\left(+\frac{1}{4}\pi-\phi_A\right)}\right]\right\} \\
&= \text{Real}\left\{Ee^{iwt}e^{-\frac{5}{4}\pi i}e^{-\frac{\phi}{2}i}\left[\frac{e^{i\left(-\frac{\phi}{2}-\frac{1}{4}\pi-\phi_B\right)} + e^{i\left(\frac{\phi}{2}+\frac{1}{4}\pi-\phi_A\right)}}{2}\right]\right\} \\
&= \text{Real}\left\{Ee^{i\left(wt+\frac{5}{4}\pi-\frac{\phi}{2}-\phi_E\right)}\left[\frac{e^{i\left(\frac{\phi}{2}+\frac{\pi}{4}\right)} + e^{-i\left(\frac{\phi}{2}+\frac{\pi}{4}\right)}}{2}\right]\right\}\text{_where_}\phi_E \\
&= \phi_A \\
&= \phi_B \\
&= E\cos\left(\frac{\phi}{2} + \frac{\pi}{4} - \phi_E\right)\cos\left(wt + \frac{5}{4}\pi - \frac{\phi}{2}\right)
\end{aligned}$$

Therefore:

$$\Phi_A = \Phi_B$$

$$\text{if } L_5 = L_1 + L_2 + L_3 + L_4$$

The coupler assembly 14' may be implemented using off-the-shelf components. It should be noted by that using off-the-shelf components, it may be desirable to assemble the apparatus 10' using multiple silver solder (dip-brazing) joints. This may increase the risk for manufacturing and/or assembling defects.

To improve manufacturability, the hybrid coupler development was investigated using a High Frequency Structure Simulator (HFSS) and Wasp-Net. The indicated planar matching (faceted) structure was modified in simulation with a continuous non-faceted structure which would facilitate the manufacturability of the hybrid coupler, as will be appreciated by those skilled in the art. It should be noted that this task would facilitate machining the entire circuit out of a single metal block thus eliminating all dip-braze/silver-solder joints.

Figure 11:
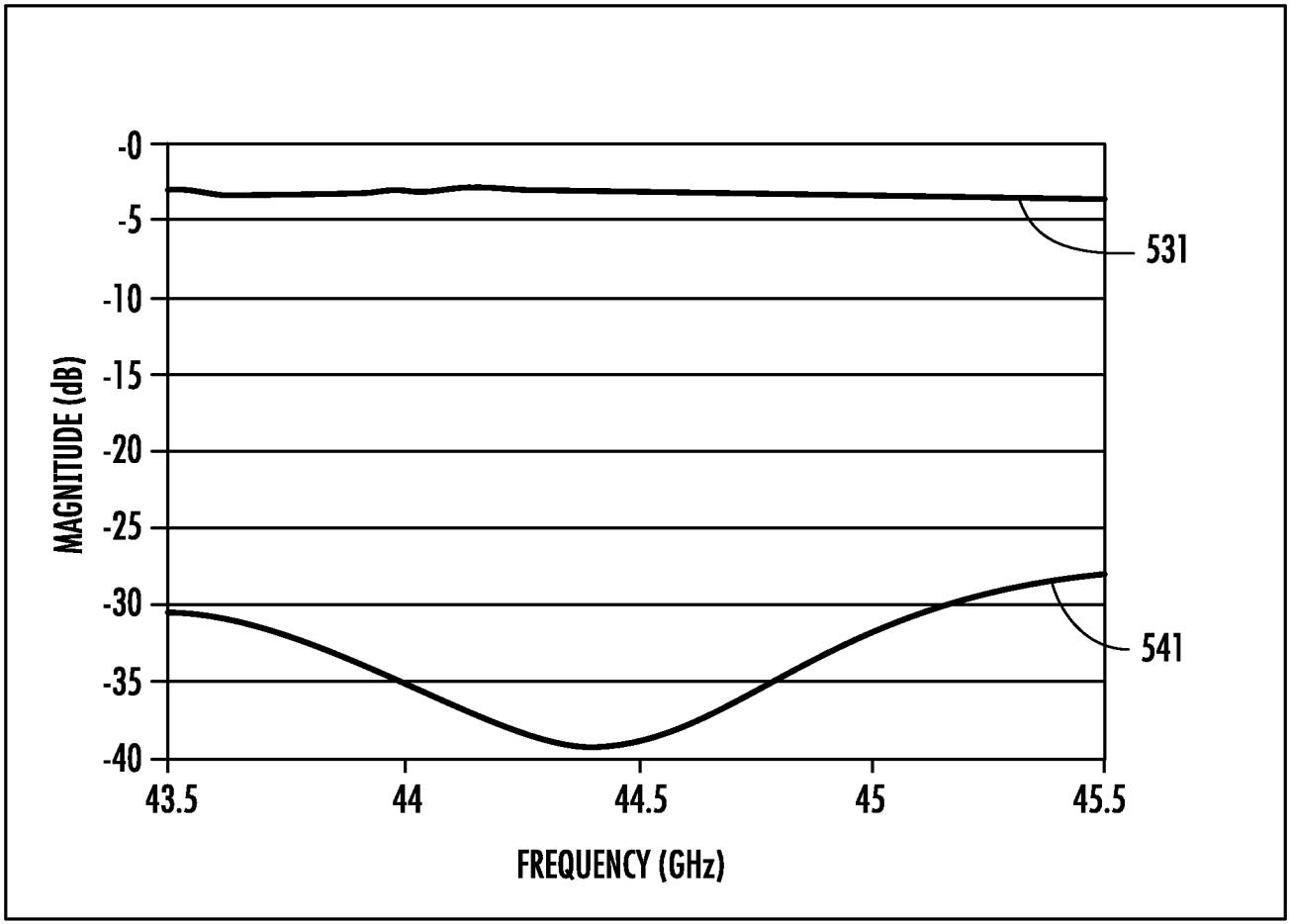
FIG. 11 is a S-parameter graph between ports of a hybrid coupler according to the present invention.
Figure 12:
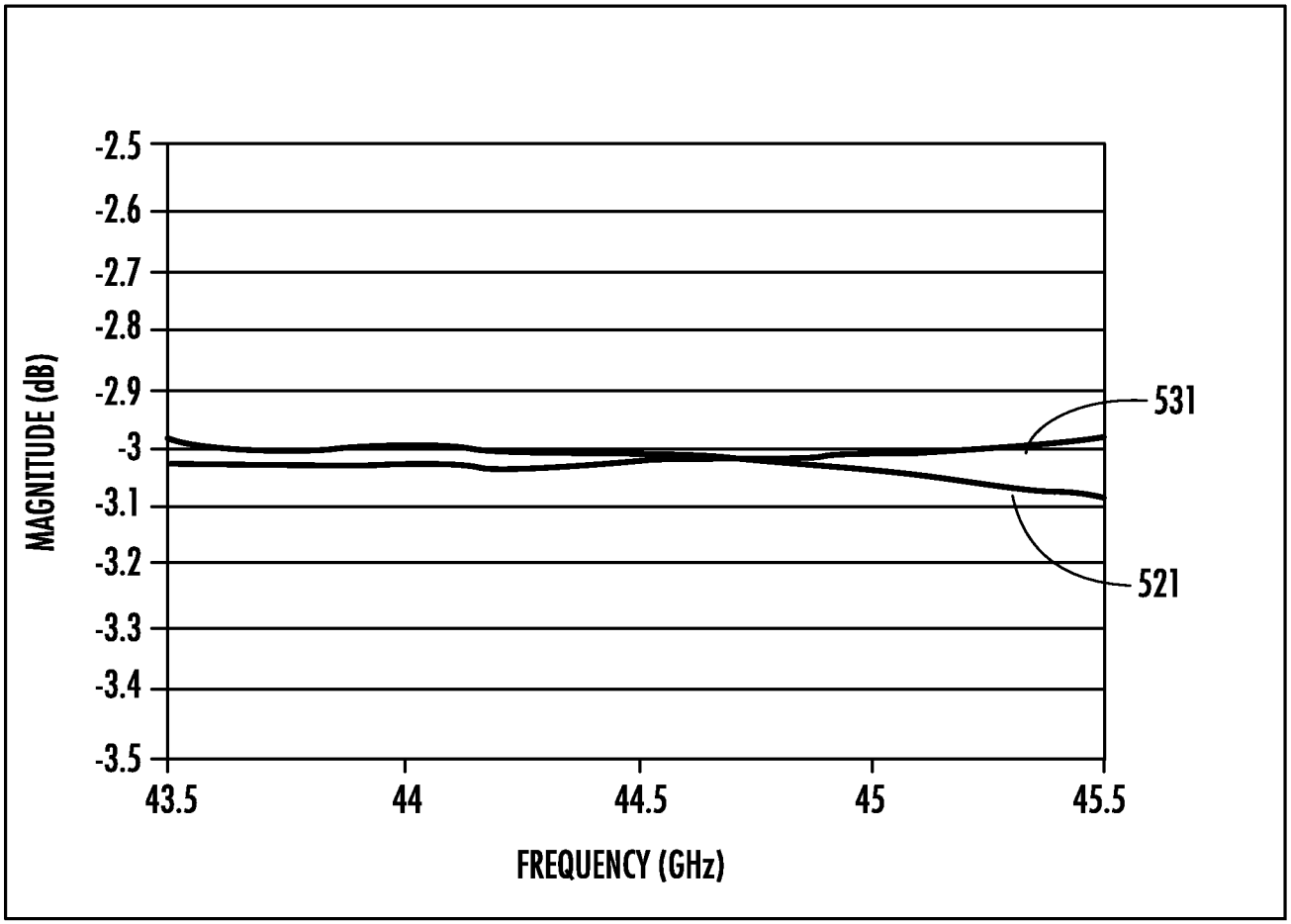
FIG. 12 is another S-parameter graph between ports of a hybrid coupler according to the present invention.
Figure 13:
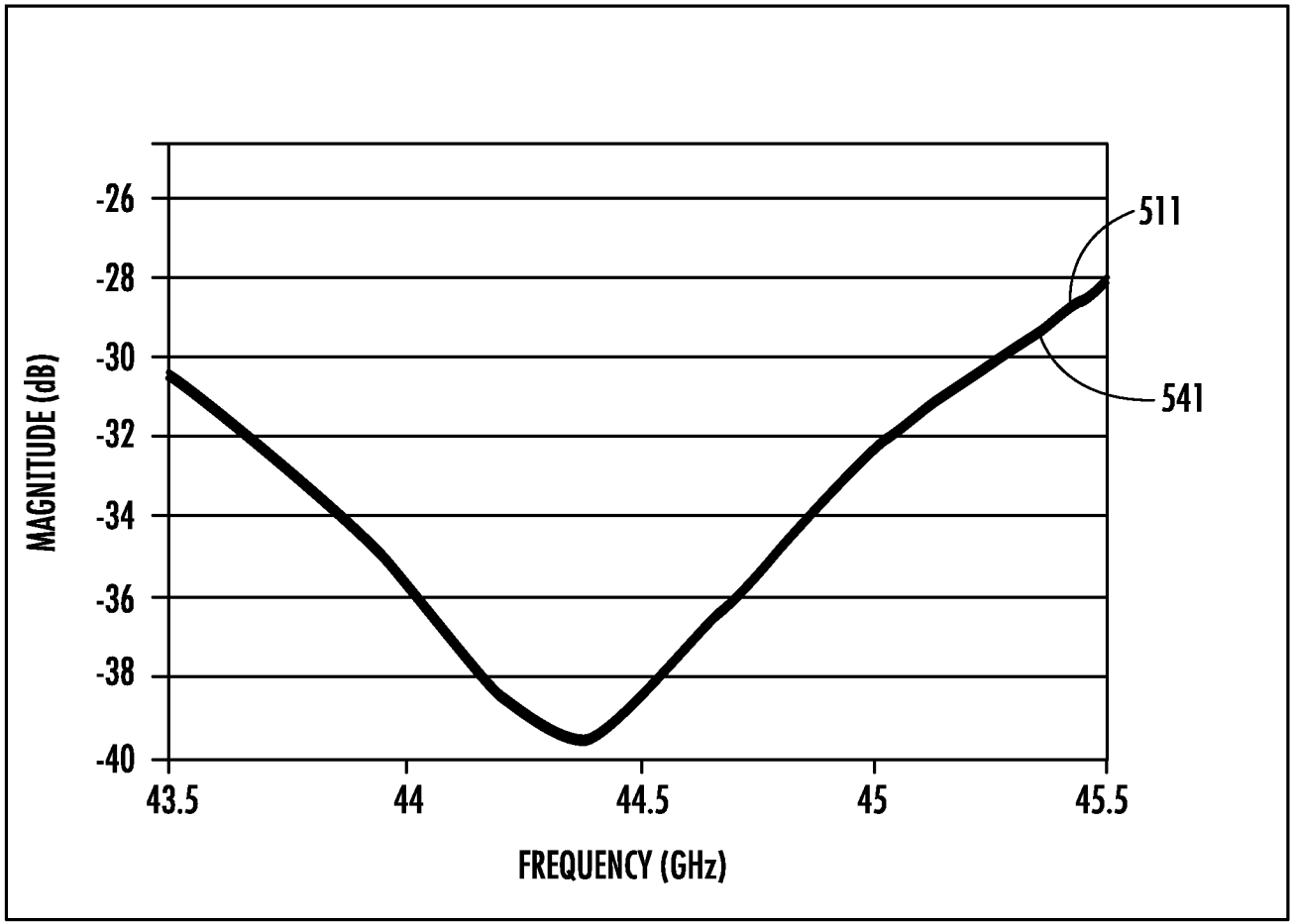
FIG. 13 is another S-parameter graph between ports of a hybrid coupler according to the present invention.
Figure 14:
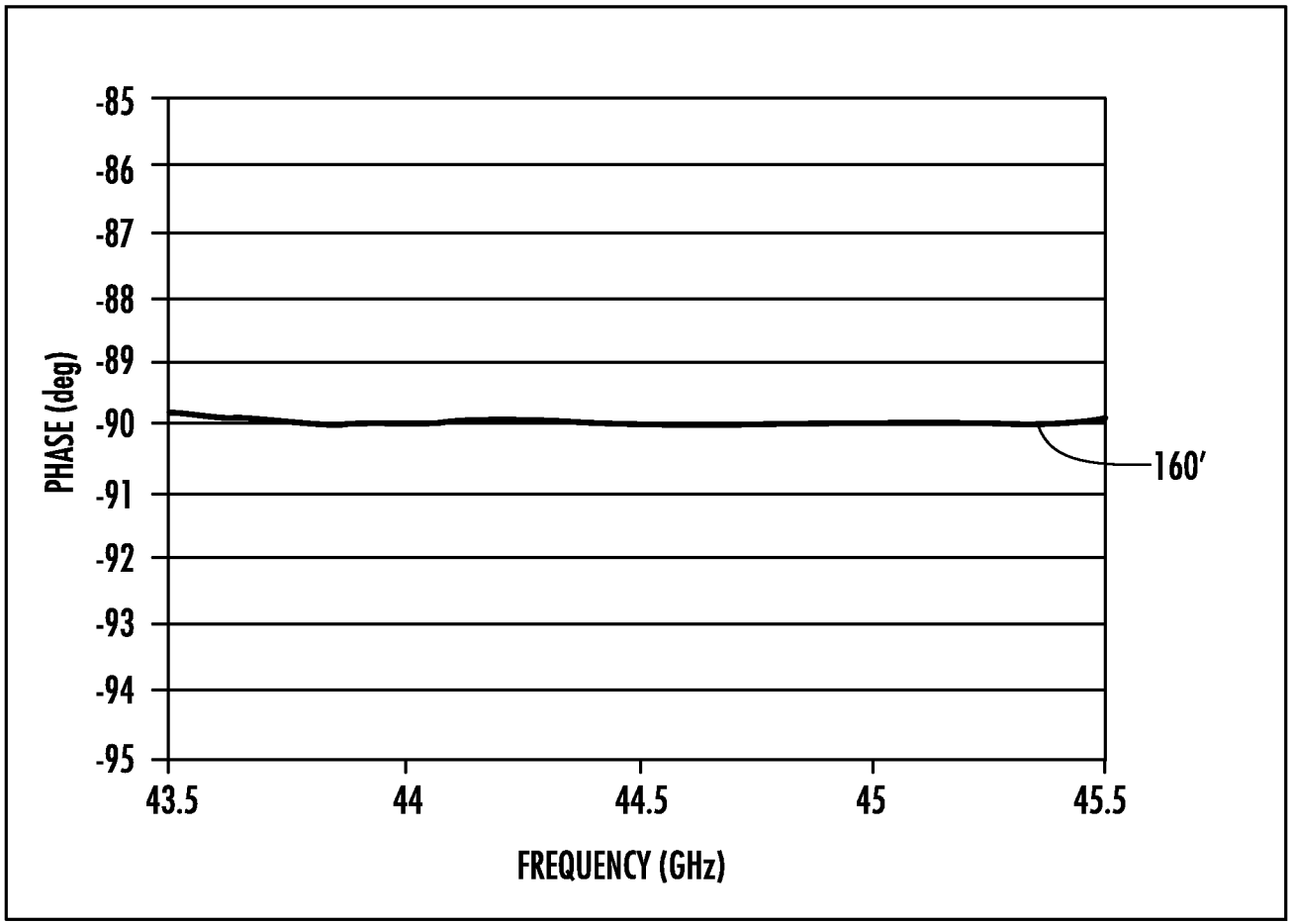
FIG. 14 is a phase difference graph between ports of a hybrid coupler according to the present invention.

Referring additionally to the graphs in FIGS. 11-13, illustrate the scattered parameters, referred to as the S-parameters, between ports of a hybrid coupler in dB. The graph in FIG. 11 illustrates the S31 and S41 parameters. Advantageously, the S41 parameter corresponds to a VSWR of about 1.07:1. The graph in FIG. 12 illustrates the S21 and S31 parameters. The graph in FIG. 13 illustrates the S11 and S41 parameters, which are overlapping. A VSWR of about 1.07:1 is achieved. Referring now to the graph in FIG. 14, a phase difference 160 between ports of the hybrid coupler is illustrated, and more particularly, phase difference between S31 and S21 is illustrated.

Figure 15:
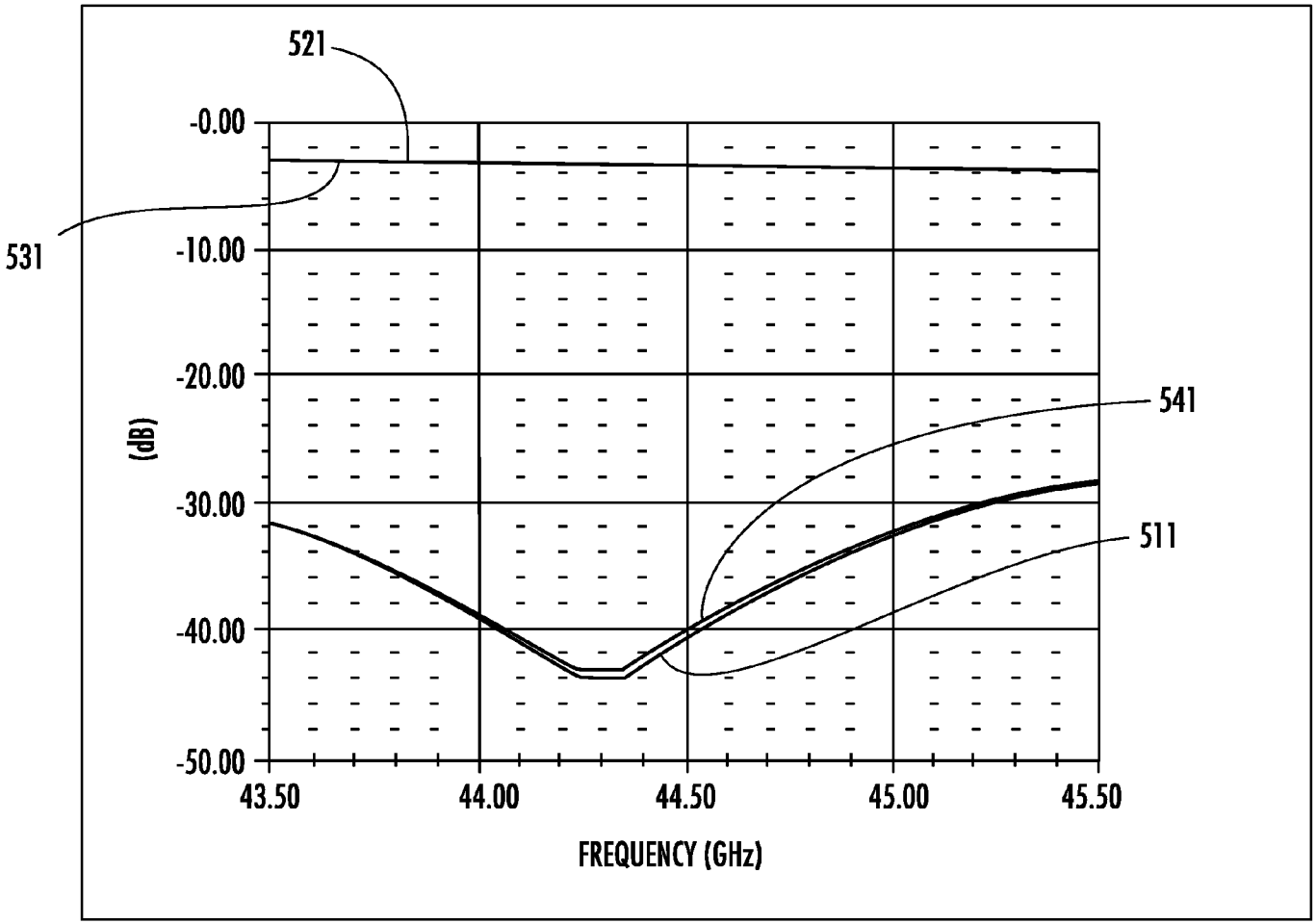
FIG. 15 is an S-parameter graph using HFSS between ports of a hybrid coupler according to the present invention.
Figure 16:
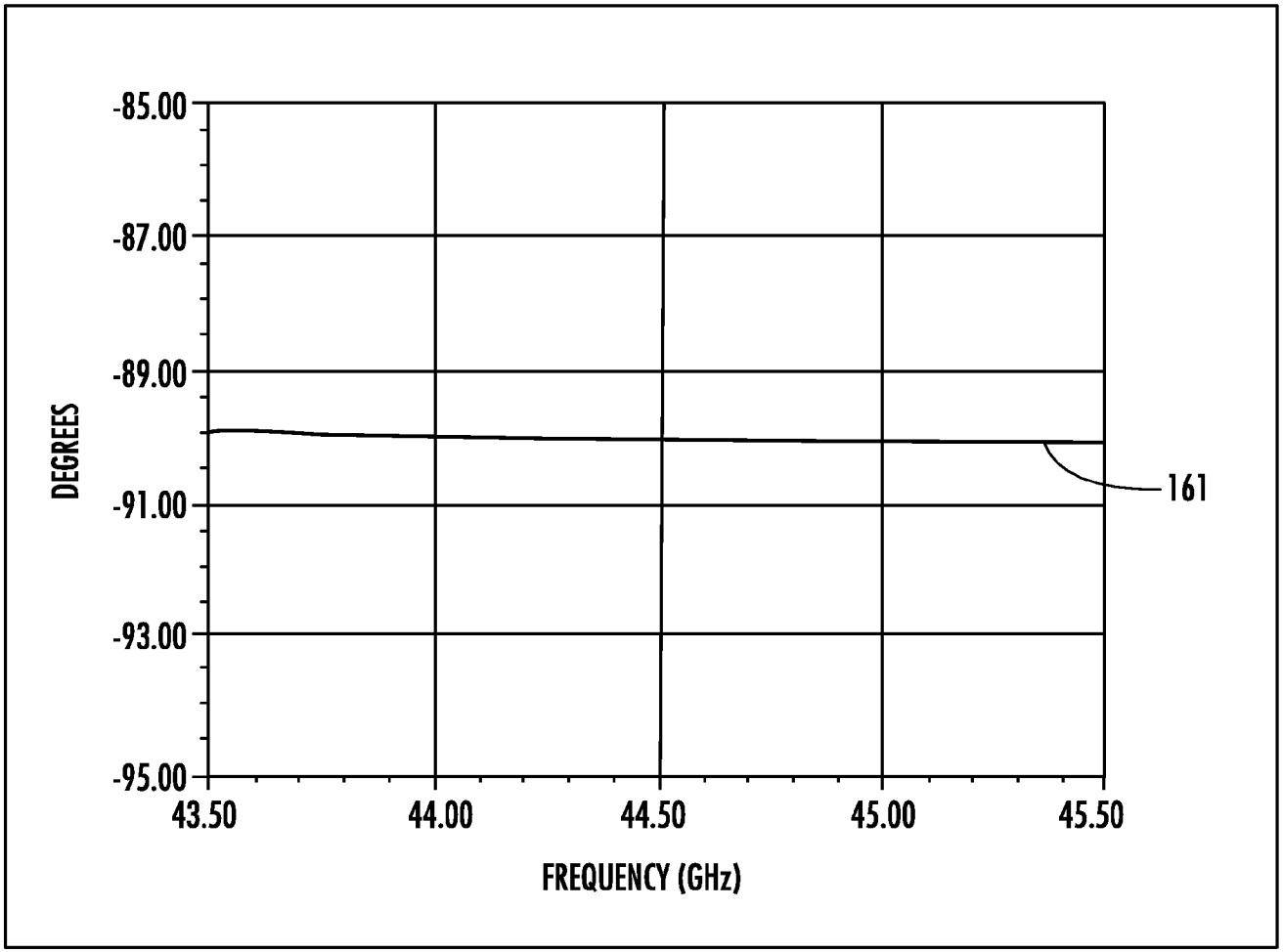
FIG. 16 is a phase difference graph using HFSS between ports of a hybrid coupler according to the present invention.

Referring additionally to the graphs in FIGS. 15-16, simulated performance, i.e., magnitude of S parameters, using HFSS is illustrated. The graph of FIG. 15 illustrates the S11, S21, S31, and S41 parameters. The graph of FIG. 16 illustrates an HFSS simulated phase difference 161.

A method aspect is directed to a method of processing a hydrocarbon resource. The method includes applying radio frequency (RF) power from an RF source 12' to distal ends 153', 154' of a first RF conductor 151' and a second RF conductor 152' having the hydrocarbon resource therebetween. The RF power is applied via a hybrid coupler assembly 14' coupled to the RF source 12' and the first and second RF conductors 151', 152'.

Further details and benefits of hydrocarbon resource processing are disclosed in application Ser. Nos. 13/209,102 and 13/161,116, assigned to the assignee of the present application, and the entire contents of which are herein incorporated by reference. Features and components of the various embodiments disclosed herein may be exchanged and substituted for one another as will be appreciated by those skilled in the art. Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A device for processing a hydrocarbon resource comprising:

a radio frequency (RF) source;

a first RF conductor;

a second RF conductor; and a hybrid coupler assembly coupled to said RF source and said first and second RF conductors;

said first and second RF conductors each having distal ends configured to receive the hydrocarbon resource therebetween and apply RF power from said RF source to the hydrocarbon resource.

2. The device according to claim 1, wherein said hybrid coupler assembly comprises:

a first hybrid coupler having a plurality of ports, one of the plurality of ports coupled to said RF source and another of said plurality of ports coupled to said first RF conductor; and a second hybrid coupler having a plurality of ports, one of the plurality of ports coupled to a further one of the plurality of ports of said first hybrid coupler.

3. The device according to claim 2, wherein said hybrid coupler assembly further comprises a third hybrid coupler having a plurality of ports, one of the plurality of ports coupled to said second RF conductor; and wherein said second hybrid coupler is coupled in series between said first and third hybrid couplers via the further one of the plurality of ports of said first hybrid coupler and another of the plurality of ports of said third hybrid coupler.

4. The device according to claim 1, further comprising a tuner coupled to said hybrid coupler assembly.

5. The device according to claim 4, wherein said tuner is configured to adjust a phase of the RF power.

6. The device according to claim 1, further comprising a load coupled to said hybrid coupler assembly.

7. The device according to claim 1, wherein said first and second RF conductors have a length corresponding to a resonant frequency of the RF source.

8. The device according to claim 1, further comprising a hydrocarbon processing container coupled between the distal ends of said first and second RF conductors.

9. The device according to claim 7, wherein said hydrocarbon processing container has a pair of RF treatment ports aligned with corresponding ends thereof.

10. A device for processing a hydrocarbon resource comprising:

a radio frequency (RF) source;

a first RF conductor;

a second RF conductor;

a hybrid coupler assembly comprising a first hybrid coupler having a plurality of ports, one of the plurality of ports coupled to said RF source and another of said plurality of ports coupled to said first RF conductor, a second hybrid coupler having a plurality of ports, one of the plurality of ports coupled to a further one of the plurality of ports of said first hybrid coupler, a third hybrid coupler having a plurality of ports, one of the plurality of ports coupled to said second RF conductor, said second hybrid coupler being coupled in series between said first and third hybrid couplers via the further one of the plurality of ports of said first hybrid coupler and another of the plurality of ports of said third hybrid coupler; and a hydrocarbon processing container coupled to distal ends of said first and second RF conductors to apply RF power from said RF source to the hydrocarbon resource within said hydrocarbon processing container.

11. The device according to claim 10, further comprising a tuner configured to adjust a phase of the RF power coupled to a pair of the plurality of ports of said second hybrid coupler.

12. The device according to claim 10, further comprising a load coupled to another one of the plurality of ports of said third hybrid coupler.

13. The device according to claim 10, wherein said first and second RF conductors have a length corresponding to a resonant frequency of the RF source.

14. The device according to claim 10, further comprising a hydrocarbon processing container coupled between the distal ends of said first and second RF conductors.

15. The device according to claim 14, wherein said hydrocarbon processing container has a pair of RF treatment ports aligned with corresponding ends thereof.

16. A method of processing a hydrocarbon resource comprising:

applying radio frequency (RF) power from an RF source to distal ends of a first RF conductor and a second RF conductor having the hydrocarbon resource therebetween, the RF power being applied via a hybrid coupler assembly coupled to the RF source and the first and second RF conductors, the hybrid coupler assembly comprising a first hybrid coupler having a plurality of ports, one of the plurality of ports coupled to the RF source and another of the plurality of ports coupled to the first RF conductor, and a second hybrid coupler having a plurality of ports, one of the plurality of ports coupled to a further one of the plurality of ports of the first hybrid coupler.

17. The method according to claim 16, wherein applying the RF power via the hybrid coupler assembly comprises applying the RF power via a hybrid coupler assembly further comprising a third hybrid coupler having a plurality of ports, one of the plurality of ports coupled to the second RF conductor, the second hybrid coupler being coupled in series between the first and third hybrid couplers via the further one of the plurality of ports of the first hybrid coupler and another of the plurality of ports of the third hybrid coupler.

18. The method according to claim 16, wherein the RF power is applied a tuner coupled to the hybrid coupler assembly.

19. The method according to claim 16, wherein the RF power is applied via a load coupled to the hybrid coupler assembly.

* * * * *